US010939730B2

(12) United States Patent
Miller

(10) Patent No.: US 10,939,730 B2
(45) Date of Patent: Mar. 9, 2021

(54) SHOE FRICTION CONTROL APPARATUS SET

(71) Applicant: Powerstrike300, Inc., Aurora, IL (US)

(72) Inventor: Martin Miller, Aurora, IL (US)

(73) Assignee: Powerstrike300, Inc., Aurora, IL (US)

( * ) Notice: Subject to any disclaimer, the term of this patent is extended or adjusted under 35 U.S.C. 154(b) by 269 days.

(21) Appl. No.: 16/005,092

(22) Filed: Jun. 11, 2018

(65) Prior Publication Data

US 2018/0352906 A1 Dec. 13, 2018

Related U.S. Application Data

(60) Provisional application No. 62/518,932, filed on Jun. 13, 2017.

(51) Int. Cl.

| | |
|---|---|
| ***A43C 19/00*** | (2006.01) |
| ***A43C 15/00*** | (2006.01) |
| ***A43B 5/00*** | (2006.01) |
| ***A43B 3/00*** | (2006.01) |
| ***A43B 5/18*** | (2006.01) |
| ***A43B 3/16*** | (2006.01) |

(52) U.S. Cl.

CPC ..... *A43C 19/00* (2013.01); *A43B 3/0078* (2013.01); *A43B 3/16* (2013.01); *A43B 5/008* (2013.01); *A43B 5/18* (2013.01); *A43C 15/00* (2013.01)

(58) Field of Classification Search

None

See application file for complete search history.

(56) References Cited

U.S. PATENT DOCUMENTS

| | | | | |
|---|---|---|---|---|
| 3,672,077 A * | 6/1972 | Coles | A43B 13/26 36/134 |
| 4,021,860 A * | 5/1977 | Swallow | B29C 65/02 2/239 |
| 4,281,466 A | 8/1981 | Malone | |
| 4,519,148 A * | 5/1985 | Sisco | A43B 5/12 36/103 |
| 4,704,810 A * | 11/1987 | Massengale | A43B 3/16 36/130 |

(Continued)

FOREIGN PATENT DOCUMENTS

| | | |
|---|---|---|
| CN | 102845908 | 1/2013 |
| EP | 3165110 | 5/2017 |

OTHER PUBLICATIONS

"Brunswick Defense Shoe Cover" https://www.amazon.com/Brunswick-BR308-L-P-Defense-Cover/dp/B008FJ8TNI available prior to Jun. 13, 2017 (4 page).

(Continued)

*Primary Examiner* — Jila M Mohandesi

(74) *Attorney, Agent, or Firm* — Neal, Gerber & Eisenberg LLC

(57) ABSTRACT

A shoe friction control apparatus set that enables a user to specifically individually select a specific slide capability for one or more of their shoes from a plurality of different specific slide capacities. In various embodiments, the present disclosure enables a bowler to make a specific individual selection for the shoe on the bowler's slide foot. In various embodiments, the present disclosure enables a bowler to make this specific individual selection for the shoe on the bowler's other, non-slide, plant or kicker foot.

18 Claims, 9 Drawing Sheets

(56) References Cited

U.S. PATENT DOCUMENTS

| | | | | | |
|---|---|---|---|---|---|
| 4,899,467 | A * | 2/1990 | Mackey | A43B 13/12 | 36/31 |
| 5,056,240 | A * | 10/1991 | Sherrill | A43B 3/16 | 36/7.3 |
| D405,243 | S * | 2/1999 | Shoemaker | D2/909 | |
| D446,912 | S | 8/2001 | Cockrell | | |
| 6,311,415 | B1 | 11/2001 | Lind | | |
| 6,405,459 | B1 * | 6/2002 | Prevost | A43B 1/0081 | 36/100 |
| 6,598,324 | B1 * | 7/2003 | Tsuji | A43B 1/0081 | 36/100 |
| 7,203,985 | B2 * | 4/2007 | Cox | A43B 1/0027 | 12/146 B |
| 8,789,297 | B1 * | 7/2014 | Doyle | A43B 5/005 | 36/130 |
| 8,813,394 | B2 * | 8/2014 | Weidman | A43B 5/008 | 36/100 |
| D781,537 | S | 3/2017 | Ungania et al. | | |
| 2002/0144437 | A1 | 10/2002 | Davis | | |
| 2006/0053660 | A1 * | 3/2006 | Lewton | A43B 13/36 | 36/59 R |
| 2008/0052957 | A1 | 3/2008 | Taheri | | |
| 2011/0035964 | A1 | 2/2011 | Gallagher | | |
| 2013/0000153 | A1 * | 1/2013 | Weidman | A43B 13/36 | 36/103 |
| 2014/0290099 | A1 * | 10/2014 | Corbett | A43B 13/181 | 36/103 |
| 2014/0325877 | A1 * | 11/2014 | Santos | A43B 3/246 | 36/103 |
| 2014/0338090 | A1 | 11/2014 | Perkins | | |
| 2015/0320142 | A1 * | 11/2015 | Handelman | A43B 5/005 | 36/15 |
| 2016/0095386 | A1 * | 4/2016 | Macfarlane | A43B 13/37 | 36/15 |

OTHER PUBLICATIONS

"Bowling Slide Aids _ BowlersParadise" http://shop.bowlersparadise.com/bowling-accessories/bowling-slide-aids available prior to Jun. 13, 2017 (1 page).

* cited by examiner

SHOE FRICTION CONTROL APPARATUS SET

PRIORITY CLAIM

This application claims priority to and the benefit of U.S. Provisional Patent Application No. 62/518,932, filed Jun. 13, 2017, the entire contents of which are incorporated herein by reference.

BACKGROUND

In the sport of bowling, a bowler typically takes several steps before releasing a bowling ball into a bowling lane in a bowling center. The area in which the bowler takes such steps or makes the bowler's approach to a bowling lane during the bowling motion is referred to herein as the bowling lane approach area.

Bowlers typically wear bowling shoes on both feet when bowling at a bowling center. Known bowling shoes are typically configured to enable a bowler to slide in the bowler's approach to the bowling lane (or to the foul line of the lane) and just prior to, at the same time of, and/or just after the bowler's release of the bowling ball. More specifically, when a bowler approaches a bowling lane in a bowling lane approach area and performs a ball throwing motion, typically a first one of the bowler's feet performs a sliding function and a second one of the bowler's feet performs a kicking function. For a right-handed bowler, the left foot performs the slide function and the right foot performs the kicking function. For a left-handed bowler, the right foot performs the slide function and the left foot performs the kicking function. Each bowler typically has their own specific style that the bowler uses during the bowler's approach to the bowling lane in the bowling lane approach area and during the bowler's ball release motion.

The condition of the surface of the bowling lane approach area to the bowling lane typically affects the slide of the bowler, how the bowler slides, the amount of slide, how the bowler releases the ball, and ultimately how the bowler bowls.

One significant problem relating to the sliding and ball release motion is that different bowling lanes and bowling lane approach areas in the same bowling center often do not have uniformly conditioned surfaces. Likewise, different bowling lanes and bowling lane approach areas in different bowling centers typically do not have uniformly conditioned surfaces. For example, one bowling lane approach area may have a smoother; more polished, or more slippery surface condition that makes sliding easier, and another bowling lane approach area may have a rougher, less polished, stickier, or tackier surface condition that makes sliding more difficult. The ranges of the surface conditions for such bowling lane approach areas in bowling centers can vary significantly. In fact, most different bowling centers have at least slightly different surface conditions.

Thus, for a bowler to achieve the bowler's desired slide and ball release motion, on each different bowling lane approach area in each different bowling center, the bowler must judge the surface condition of the bowling lane approach area and make suitable adjustments.

One proposed way to make these adjustments is for the bowler to have multiple different pairs of the bowling shoes on hand that have different soles or bottom surfaces to account for the widely varying bowling lane approach area surface conditions that are likely to be encountered by the bowler at different bowling centers. Requiring such multiple different bowling shoes is fairly expensive and not a practical solution for many bowlers.

Several different types of bowling shoe attachments and other products have been also been developed, used, and proposed, but no known products provide a universal solution to this problem.

Additionally, another disadvantage with conventional bowling shoes is that they are identical, even though the functions of the bowler's feet are different during the bowler's approach and ball release motion. Thus, the typical pair of bowling shoes does not provide optimum performance for the different functions performed by each of the bowler's different feet.

Accordingly, there is a need to solve these problems.

SUMMARY

Various embodiments of the present disclosure solve these problems by providing a shoe friction control apparatus set or shoe slide control apparatus set that enables a user to specifically individually select a specific slide capability (that will provide a desired coefficient of friction with the bowling lane approach area) for one or more of the bowler's shoes. In various embodiments, the present disclosure enables a bowler to make this specific individual selection for the shoe on the bowler's slide foot. In various embodiments, the present disclosure also enables a bowler to make this specific individual selection for the shoe on the bowler's other, non-slide, plant or kicker foot.

In various embodiments of the present disclosure, the shoe friction control apparatus set includes: (a) a first shoe friction control apparatus configured to provide a first amount of slide capability for an extremely sticky or tacky bowling lane approach area; (b) a second shoe friction control apparatus configured to provide a second different amount of slide capability for a moderately sticky or tacky bowling lane approach area; (c) a third shoe friction control apparatus configured to provide a third different amount of slide capability for a slightly slippery bowling lane approach area; (d) a fourth shoe friction control apparatus configured to provide a fourth different amount slide capability for a moderately slippery bowling lane approach area; and (e) a fifth shoe friction control apparatus configured to provide a fifth different amount of slide capability for an extremely slippery bowling lane approach area or for a bowler that wants little to no slide. In certain such embodiments: (i) the first amount of slide capability is greater than the second amount of slide capability, (ii) the second amount of slide capability is greater than the third amount of slide capability, (iii) the third amount of slide capability is greater than the fourth amount of slide capability, and (iv) the fourth amount of slide capability is greater than the fifth amount of slide capability.

In various embodiments of the present disclosure, the shoe friction control apparatus set includes at least two of or two or more of: (a) the first shoe friction control apparatus configured to provide the first amount of slide capability; (b) the second shoe friction control apparatus configured to provide the second amount of slide capability; (c) the third shoe friction control apparatus configured to provide the third amount of slide capability; (d) the fourth shoe friction control apparatus configured to provide the fourth amount slide capability; and (e) the fifth shoe friction control apparatus configured to provide the fifth amount of slide capability, wherein: (i) the first amount of slide capability is greater than the second amount of slide capability, (ii) the second amount of slide capability is greater than the third amount of slide capability, (iii) the third amount of slide capability is greater than the fourth amount of slide capability, and (iv) the fourth amount of slide capability is greater than the fifth amount of slide capability, Each shoe friction control apparatus of the shoe friction control apparatus set thus provides for a different coefficient of friction with the surface of the bowling lane approach area. Thus, each shoe friction control apparatus of the shoe friction control apparatus set is configured to enable a bowler to select an individual specific amount of desired slide (or no slide) during the bowler's approach and follow through motion. The present disclosure thus enables a bowler to account for the specific condition of the surface of the approach area to a bowling lane, and to select a corresponding specific shoe friction control apparatus of the shoe friction control apparatus set to provide for the desired amount of slide of the bowler's slide foot to enhance how the bowler bowls at each particular different bowling center.

Other objects, features, and advantages of the present disclosure will be apparent from the following detailed disclosure, taken in conjunction with the accompanying sheets of drawings, wherein like reference numerals refer to like parts.

DETAILED DESCRIPTION

Figure 1:
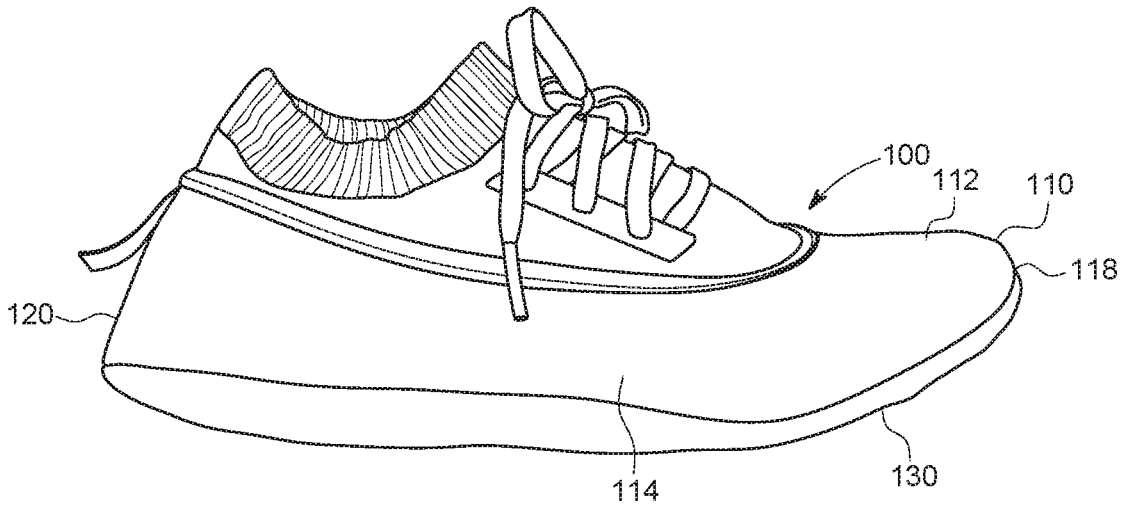
FIG. 1 is a right side perspective view of a first one of the shoe friction control apparatus of the shoe friction control apparatus set of one embodiment of the present disclosure.
Figure 2:
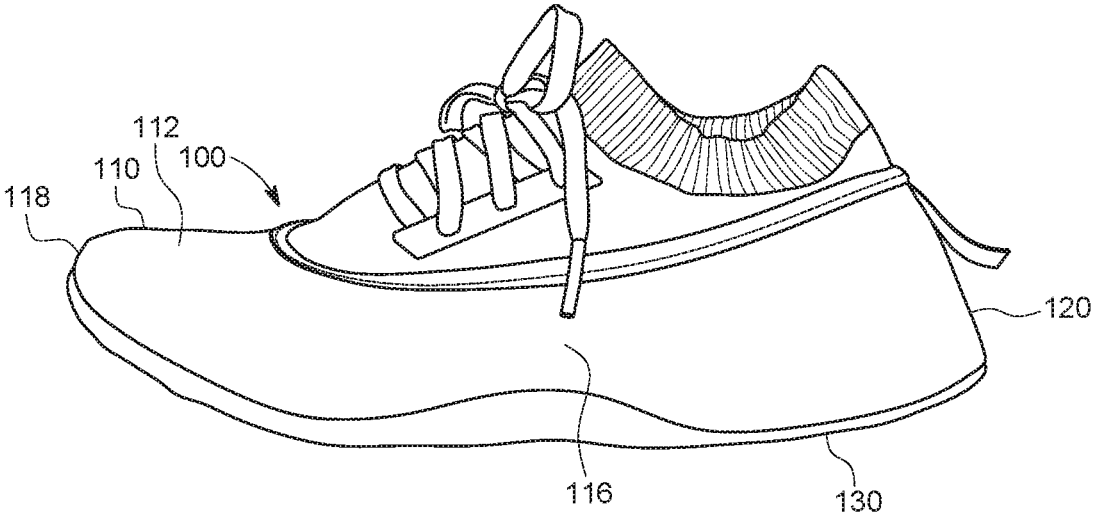
FIG. 2 is a left side perspective view of the shoe friction control apparatus of FIG. 1.
Figure 3:
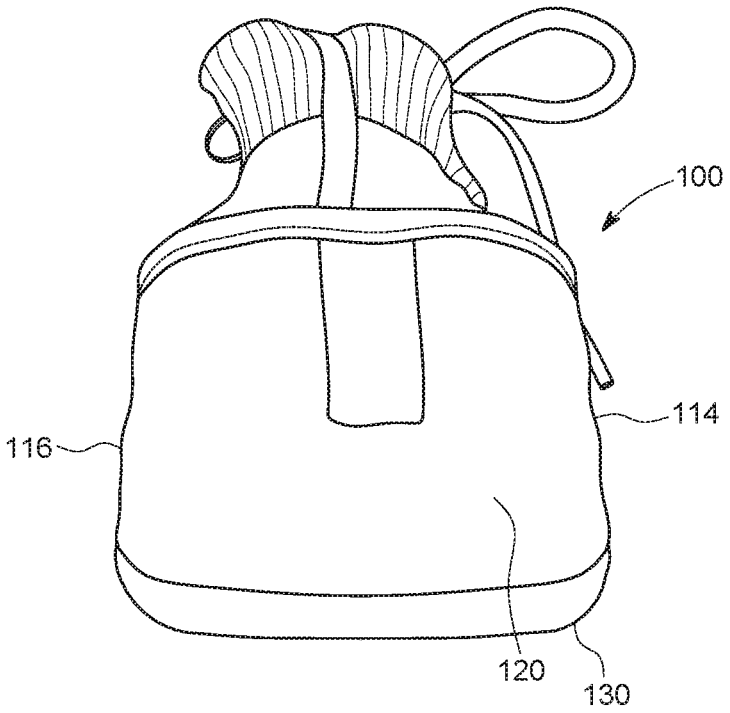
FIG. 3 is a rear perspective view of the shoe friction control apparatus of FIG. 1.
Figure 4:
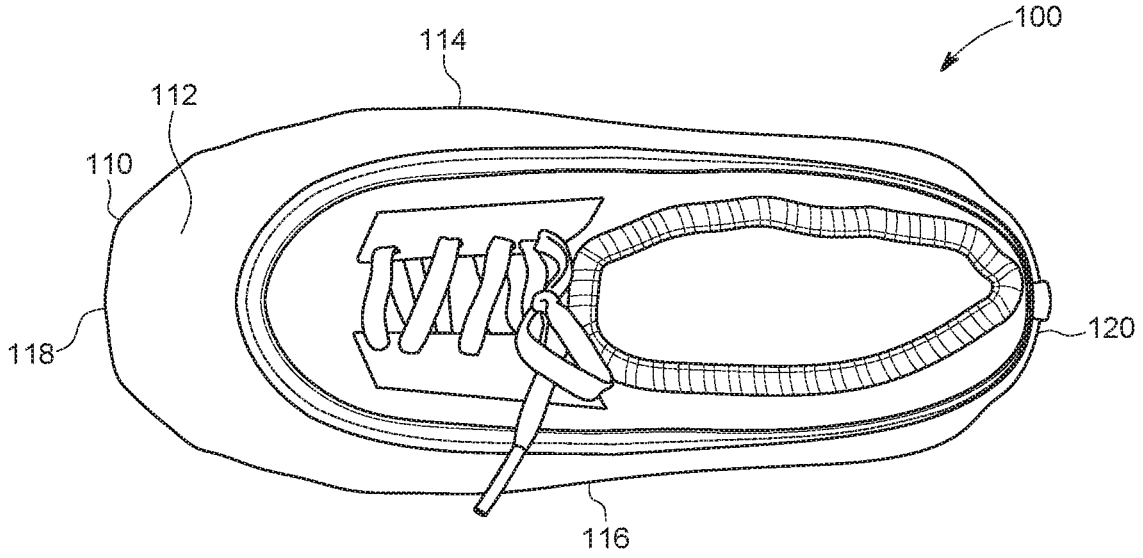
FIG. 4 is a top perspective view of the shoe friction control apparatus of FIG. 1.

Referring now to the Figures, a shoe friction control apparatus set of one example embodiment of the present disclosure is generally illustrated in FIGS. 1, 2, 3, 4, 5, 6, 7, 8, and 9. This illustrated example shoe friction control apparatus set includes five different individual shoe friction control apparatus respectively labeled 100, 200, 300, 400, and 500.

Each shoe friction control apparatus of the shoe friction control apparatus set of this illustrated example embodiment has the same general body configuration or structure, and differs in the permanent attachments to or formed in the bottom section of the body. The respective top sections, right side sections, left side section, front sections, and back sections of the bodies of each of the shoe friction control apparatus 100, 200, 300, 400, and 500 of the shoe friction control apparatus set are identical in this illustrated example embodiment. It should be appreciated that the bodies of each of the shoe friction control apparatus of the shoe friction control apparatus set do not need to be identical in accordance with the present disclosure and can be different in various ways. For example, each body can have a different indication of the slide capability of the respective bottom section. The bodies can also be different in one or more colors.

For brevity, only the top section, right side section, left side section, front section, and back section of the body of the shoe friction control apparatus 100 are labeled and discussed with respect to FIGS. 1, 2, 3, and 4. FIGS. 5, 6, 7, 8, and 9 respectively separately show the bases of the bottom sections and attachments of each of five different shoe friction control apparatus 100, 200, 300, 400, and 500 of the shoe friction control apparatus set of this illustrated example embodiment.

Each shoe friction control apparatus 100, 200, 300, 400, and 500 is configured to be: (a) easily and quickly mounted on or placed over or on a shoe of a bowler, and (b) easily and quickly taken off from a shoe of a bowler.

More specifically, the illustrated example shoe friction control apparatus 100 includes a body 110 having a top section 112, a right side section 114, a left side section 116, a front section 118, a back section 120, and a bottom section 130. In this illustrated example embodiment, the top section 112, the right side section 114, the left side section 116, the front section 118, the back section 120, and the base of the bottom section 130 are integrally connected (such as by sewing or stitching) and made from suitable materials (such as a 100% cotton 10 oz denim material for the base of the bottom section 130 and a stretchable material such as a 95% cotton and 5% spandex material for the top section 112, the right side section 114, the left side section 116, the front section 118, and the back section 120). It should be appreciated that the body can be made from other suitable materials. It should also be appreciated that the body can be made in other suitable configurations. The body 110 and specifically, the top section 112, the right side section 114, the left side section 116, the front section 118, the back section 120, and the base of the bottom section 130 are configured to be easily removably mounted on or placed over a shoe such as a bowling shoe as shown in FIGS. 1, 2, 3, and 4.

Figure 5:
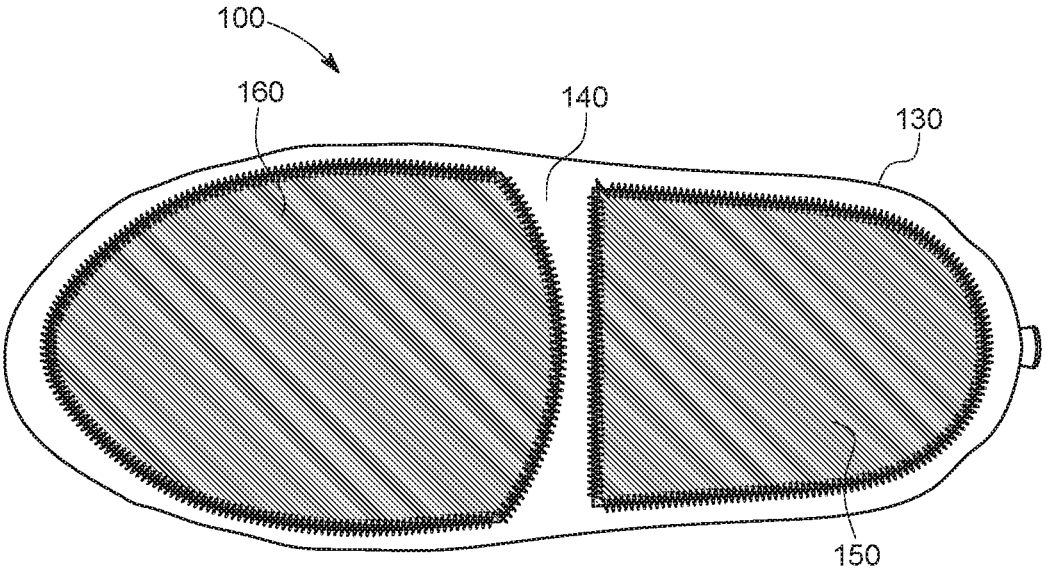
FIG. 5 is a bottom perspective view of the shoe friction control apparatus of FIG. 1.
Figure 6:
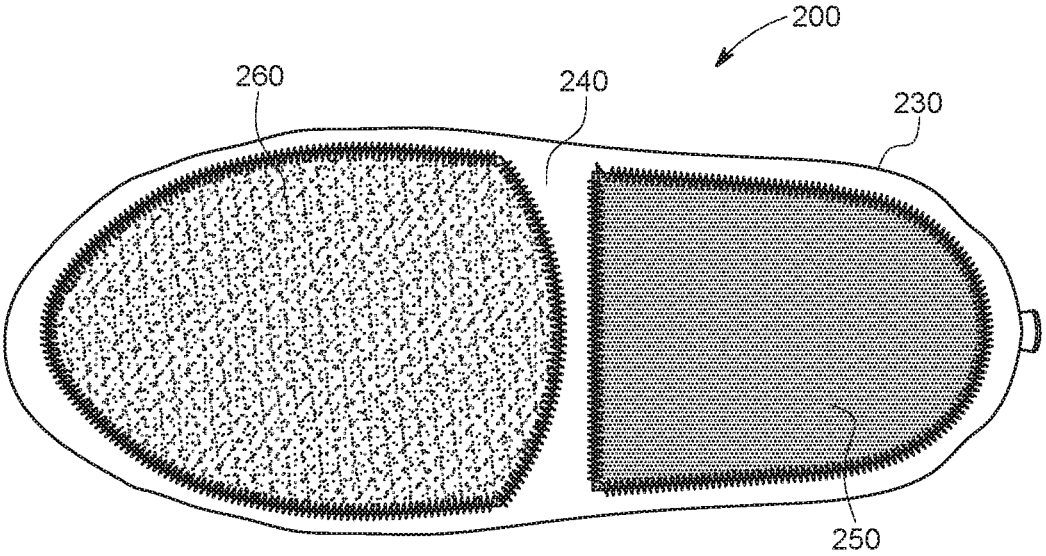
FIG. 6 is a bottom perspective view of a second one of the shoe friction control apparatus of the shoe friction control apparatus set of one embodiment of the present disclosure.
Figure 7:
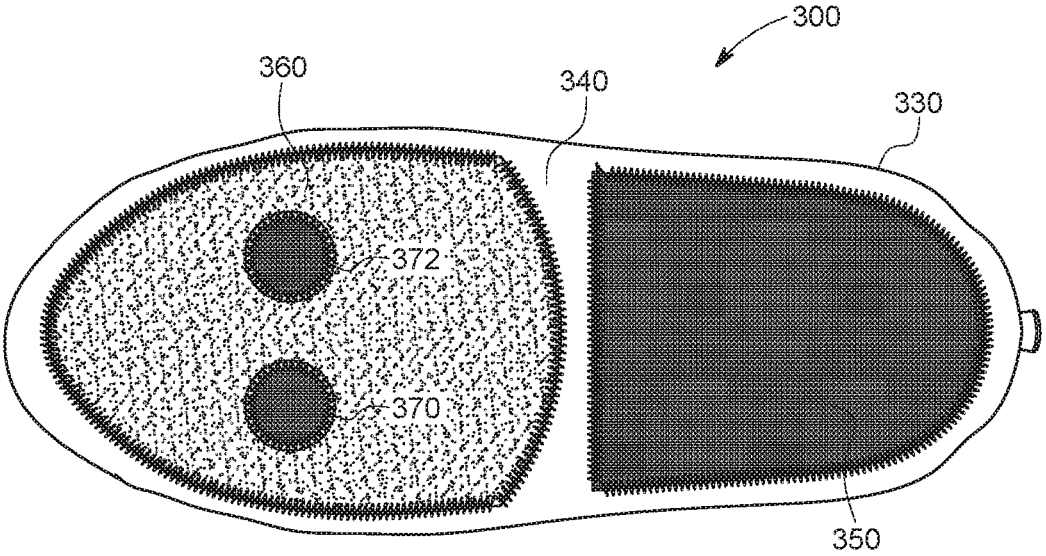
FIG. 7 is a bottom perspective view of a third one of the shoe friction control apparatus of the shoe friction control apparatus set of one embodiment of the present disclosure.
Figure 8:
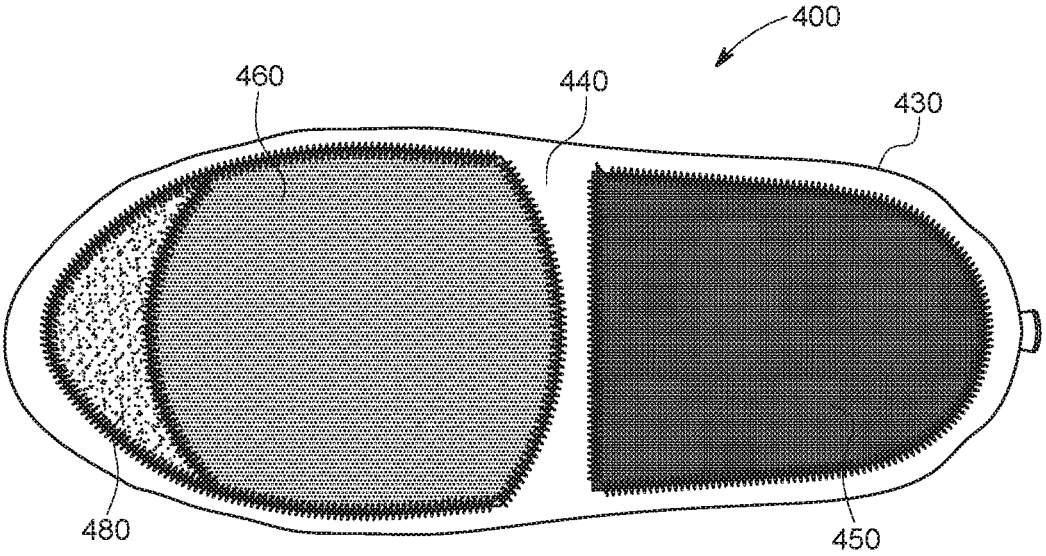
FIG. 8 is a bottom perspective view of a fourth one of the shoe friction control apparatus of the shoe friction control apparatus set of one embodiment of the present disclosure.
Figure 9:
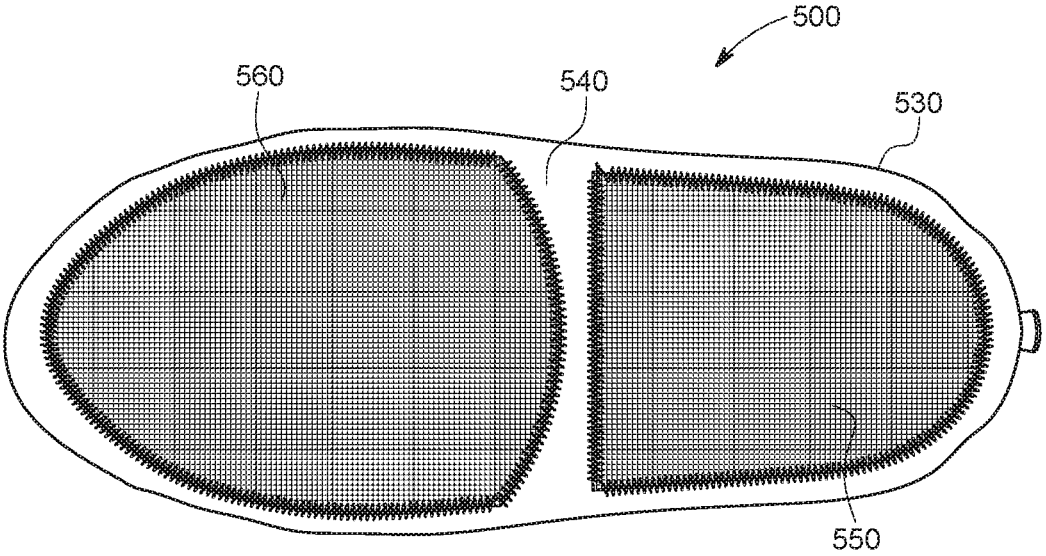
FIG. 9 is a bottom perspective view of a fifth one of the shoe friction control apparatus of the shoe friction control apparatus set of one embodiment of the present disclosure.

As indicated above, FIGS. 5, 6, 7, 8, and 9 respectively separately show the bottom sections of each of five different individual shoe friction control apparatus 100, 200, 300, 400, and 500 of the shoe friction control apparatus set of this illustrated example embodiment of the present disclosure. For this illustrated example embodiment of the present disclosure: (a) FIG. 5 shows the bottom section 130 of the first shoe friction control apparatus 100 that provides a first amount of slide capacity and specifically a maximum or most amount slide capability of this illustrated example shoe friction control apparatus set; (b) FIG. 6 shows the bottom section 230 of the second shoe friction control apparatus 200 that provides a second different amount of slide capacity and specifically the second most amount of slide capability of this illustrated example shoe friction control apparatus set; (c) FIG. 7 shows the bottom section 330 of the third shoe friction control apparatus 300 that provides a third different amount of slide capacity and specifically the third most amount slide capability of this illustrated example shoe friction control apparatus set; (d) FIG. 8 shows the bottom section 430 of the fourth shoe friction control apparatus 400 that provides a fourth different amount of slide capacity and specifically the fourth most amount slide capability of this illustrated example shoe friction control apparatus set; and (e) FIG. 9 shows the bottom section 530 of the fifth shoe friction control apparatus 500 that provides a fifth different amount of slide capacity and specifically the fifth most (or least) amount of slide capability of this illustrated example shoe friction control apparatus set.

Each of the pads, attachments, and/or inserts for or of the bottom sections of the five different individual shoe friction control apparatus 100, 200, 300, 400, and 500 of the shoe friction control apparatus set of this illustrated example embodiment of the present disclosure are permanently attached to the bases of the respective bottom sections (such as by one or more of sewing, gluing, or other suitable fastening methods). In various embodiments, each pad, attachment, and/or insert is sewn to the base of the bottom portion around or at the edges of the entire pad, attachment, and/or insert.

More specifically, as illustrated in FIG. 5, the bottom section 130 of the first shoe friction control apparatus 100 includes: (i) a heel pad 150 attached to the base 140 of the bottom section 130 of the first shoe friction control apparatus 100; and (ii) a ball pad 160 attached to the base 140 of the bottom section 130 of the first shoe friction control apparatus 100. In this illustrated example embodiment, the heel pad 150 is made of nylon and the ball pad 160 is also made of nylon. In one such embodiment, the heel pad 150 is made of a PVC/polyprop black nylon and the ball pad 160 is also made of PVC/polyprop black nylon. This combination of the nylon heel pad 150 and the nylon ball pad 160 provide the first shoe friction control apparatus 100 with maximum or most slide or slide capability of the shoe friction control apparatus set of this illustrated example embodiment. In other words, the first shoe friction control apparatus 100 provides the highest relative slide capability or provides the lowest coefficient of friction with the bowling lane approach area of this example embodiment. The first shoe friction control apparatus 100 is configured to be used by a bowler for a bowling lane approach area that is extremely sticky or tacky.

As illustrated in FIG. 6, the bottom section 230 of the second shoe friction control apparatus 200 includes: (i) a heel pad 250 attached to the base 240 of the bottom section 230 of the second shoe friction control apparatus 200; and (ii) a ball pad 260 attached to the base 240 of the bottom section 230 of the second shoe friction control apparatus 200. In this illustrated example embodiment, the heel pad 250 is made of leather and the ball pad 260 is made of cotton. In one such embodiment, the heel pad 250 is made of a relatively smooth leather and the ball pad 260 is made of bull denim cotton. This combination of the leather heel pad 250 and the cotton ball pad 260 provide the second shoe friction control apparatus 200 with second most slide or slide capability of the shoe friction control apparatus of the shoe friction control apparatus set of this illustrated example embodiment. In other words, the second shoe friction control apparatus 200 provides the second highest relative slide capability or provides the second lowest coefficient of friction with the bowling lane approach area of this example embodiment. The second shoe friction control apparatus 200 is configured to be used by a bowler for a bowling lane approach area that is moderately sticky or tacky.

As illustrated in FIG. 7, the bottom section 330 of the third shoe friction control apparatus 300 includes: (i) a heel pad 350 attached to the base 340 of the bottom section 330 of the third shoe friction control apparatus 300; (ii) a ball pad 360 attached to the base 340 of the bottom section 330 of the third shoe friction control apparatus 300; and (iii) one or more friction increase inserts such as friction increase inserts 370 and 372 attached to the ball pad 360. In this illustrated example embodiment, the heel pad 350 is made of suede, the ball pad 360 is made of cotton, and the friction increase inserts 370 and 372 are made of suede. In one such embodiment, the heel pad 350 is made of suitable suede, the ball pad 260 is made of bull denim cotton, and the friction increase inserts 370 and 372 are made of a suitable suede. This combination of the suede heel pad 350, the cotton ball pad 360, and the suede friction increase inserts 370 and 372 provide the third shoe friction control apparatus 300 with third most slide or slide capability of the shoe friction control apparatus of the shoe friction control apparatus set of this illustrated example embodiment. In other words, the third shoe friction control apparatus 300 provides the third highest relative slide capability or provides the third lowest coefficient of friction with the bowling lane approach area of this example embodiment. The third shoe friction control apparatus 300 is configured to be used by a bowler for a bowling lane approach area that is somewhat too slippery.

As illustrated in FIG. 8, the bottom section 440 of the fourth shoe friction control apparatus 400 includes: (i) a heel pad 450 attached to the base 440 of the bottom section 430 of the fourth shoe friction control apparatus 300; (ii) a ball pad 360 attached to the base 440 of the bottom section 430 of the fourth shoe friction control apparatus 400; and (iii) a toe pad 480 attached to the base 440 of the bottom section 430 of the fourth shoe friction control apparatus 400. In this illustrated example embodiment, the heel pad 450 is made of suede, the ball pad 460 is made of leather, and the toe pad 480 is made of cotton. In one such embodiment, the heel pad 450 is made of suitable suede, the ball pad 460 is made of relatively smooth leather, and the toe pad 480 is made of a bull denim cotton. This combination of the suede heel pad 450, the suede ball pad 460, and the cotton toe pad 480 provide the fourth shoe friction control apparatus 400 with fourth most slide or slide capability of the shoe friction control apparatus of the shoe friction control apparatus set of this illustrated example embodiment. In other words, the fourth shoe friction control apparatus 400 provides the fourth highest relative slide capability or provides the fourth lowest coefficient of friction with the bowling lane approach area of this example embodiment. The fourth shoe friction control apparatus 400 is configured to be used by a bowler for a bowling lane approach area that is moderately slippery because it provides more grip.

As illustrated in FIG. 9, the bottom section 530 of the fifth shoe friction control apparatus 500 includes: (i) a heel pad 550 attached to the base 540 of the bottom section 530 of the fifth shoe friction control apparatus 500; and (ii) a ball pad 560 attached to the base 540 of the bottom section 530 of the fifth shoe friction control apparatus 500. In this illustrated example embodiment, the heel pad 550 is made of a relatively tacky material such as a rubber or rubbery material or contact paper type material and the ball pad 560 is made of relatively tacky material such as rubber material or a contact paper type material. In one such embodiment, the heel pad 550 is made of grip premium liner and the ball pad 560 is made of a grip premium liner. This combination of the heel pad 550 and the ball pad 560 provide the fifth shoe friction control apparatus 500 with the least most slide or slide capability of the shoe friction control apparatus of the shoe friction control apparatus set of this illustrated example embodiment. In other words, the fifth shoe friction control apparatus 500 provides the lowest relative slide capability or provides the fifth lowest (or highest) coefficient of friction with the bowling lane approach area of this example embodiment. The fifth shoe friction control apparatus 500 is configured to be used by a bowler for a bowling lane approach area that is extremely slippery. This fifth shoe friction control apparatus 500 enables a bowler to mostly or completely limit the bowler's slide (i.e., totally or almost totally prevent sliding).

It should be appreciated that the quantity of shoe friction control apparatus in the shoe friction control apparatus set can vary in accordance with the present disclosure.

It should be appreciated that the shoe friction control apparatus of the set can be made in or for different shoe sizes.

It should be appreciated that the shoe friction control apparatus of the set can be made to fit over or on different shoe sizes.

It should be appreciated that each shoe friction control apparatus is configured to be mounted on the slide shoe of the bowler (i.e., the left shoe for right handed bowlers and the right shoe for left handed bowlers).

It should further be appreciated from the above that the respective shoe friction control apparatus of the shoe friction control apparatus set will facilitate a selected amount of more or additional slide (than provided by the bowling shoe that the bowler is wearing) for the bowler's slide foot when desired by the bowler for a particular bowling lane approach area.

It should further be appreciated from the above that if a bowler desires less slide (than provided by the bowling shoe that the bowler is wearing) for the bowler's slide foot for a particular bowling lane approach area, the respective shoe friction control apparatus of the shoe friction control apparatus set will facilitate a selected amount of less slide.

It should further be appreciated from the above that if a bowler desires more or less frictional engagement with the bowling lane approach area for the bowler's other or kicker or plant foot (than provided by the bowling shoe that the bowler is wearing on that foot), the bowler can use a respective one of the shoe friction control apparatus of the shoe friction control apparatus set to facilitate such desired frictional engagement.

It should be appreciated from the above that certain embodiments of the present disclosure provide five different combinations of shoe friction control apparatus needed to create the different desired slides for the individual bowler for all or the majority of known bowling centers based on the experience of the inventor.

It should be appreciated from the above that certain embodiments of the present disclosure provide a different quantity (other than 5) of combinations of shoe friction control apparatus needed to create the desired slide for the individual bowler.

In various embodiments of the present disclosure, each shoe friction control apparatus of the set is sized and configured to fit over a bowling shoe.

In various embodiments of the present disclosure, each shoe friction control apparatus of the set can be sized and configured to fit on a gym shoe, sneaker, or other suitable shoe. In such embodiments, the shoe friction control apparatus set of the present disclosure enables a bowler to bowl without wearing a pair of bowling shoes.

In various embodiments of the present disclosure, each shoe friction control apparatus of the set can be labeled such as with numbering or other suitable symbols or images to indicate the amount of slide provided by that specific shoe friction control apparatus, or to indicate what type of bowling lane approach area that specific shoe friction control apparatus should be used on.

In various embodiments of the present disclosure, the entire shoe friction control apparatus set are packaged together or provided in one container.

In various embodiments of the present disclosure, two or more of the shoe friction control apparatus of the set are packaged together or provided in one container.

In various embodiments of the present disclosure, each shoe friction control apparatus of the set is packaged individually or separately provided in separate containers.

It should further be appreciated that the present disclosure provides each of the individual shoe friction control apparatus described above.

It will be understood that modifications and variations may be effected without departing from the scope of the novel concepts of the present invention, and it is understood that this application is to be limited only by the scope of the claims.

The invention is claimed as follows:

1. A shoe friction control apparatus set comprising:

(a) a first shoe friction control apparatus including a first body having a first top section, a first right side section, a first left side section, a first front section, a first back section, and a first bottom section, the first body configured to fit on a shoe, said first bottom section including a first base and first materials permanently attached to the first base such that the first bottom section is configured to provide a first amount of slide capability, and wherein the first top section is more stretchable than the first base of the first bottom section;

(b) a second shoe friction control apparatus including a second body having a second top section, a second right side section, a second left side section, a second front section, a second back section, and a second bottom section, the second body configured to fit on a shoe, said second bottom section including a second base and second materials permanently attached to the second base such that the second bottom section is configured to provide a second amount of slide capability, and wherein the second top section is more stretchable than the second base of the second bottom section;

(c) a third shoe friction control apparatus including a third body having a third top section, a third right side section, a third left side section, a third front section, a third back section, and a third bottom section, the third body configured to fit on a shoe, said third bottom section including a third base and third materials permanently attached to the third base such that the third bottom section is configured to provide a third amount of slide capability, and wherein the third top section is more stretchable than the third base of the third bottom section;

(d) a fourth shoe friction control apparatus including a fourth body having a fourth top section, a fourth right side section, a fourth left side section, a fourth front section, a fourth back section, and a fourth bottom section, the fourth body configured to fit on a shoe, said fourth bottom section including a fourth base and fourth materials permanently attached to the fourth base such that the fourth bottom section is configured to provide a fourth amount of slide capability, and wherein the fourth top section is more stretchable than the fourth base of the fourth bottom section; and (e) a fifth shoe friction control apparatus including a fifth body having a fifth top section, a fifth right side section, a fifth left side section, a fifth front section, a fifth back section, and a fifth bottom section, the fifth body configured to fit on a shoe, said fifth bottom section including a fifth base and fifth materials permanently attached to the fifth base such that the fifth bottom section is configured to provide a fifth amount of slide capability, and wherein the fifth top section is more stretchable than the fifth base of the fifth bottom section, wherein:

(i) the first amount of slide capability is greater than the second amount of slide capability, (ii) the second amount of slide capability is greater than the third amount of slide capability, (iii) the third amount of slide capability is greater than the fourth amount of slide capability, and (iv) the fourth amount of slide capability is greater than the fifth amount of slide capability.

2. The shoe friction control apparatus set of claim 1, wherein the first materials permanently attached to the first base of the first bottom section of the first shoe friction control apparatus include: (i) a nylon heel pad; and (ii) a nylon ball pad.

3. The shoe friction control apparatus set of claim 1, wherein the second materials permanently attached to the second base of the second bottom section of the second shoe friction control apparatus include: (i) a leather heel pad; and (ii) a cotton ball pad.

4. The shoe friction control apparatus set of claim 1, wherein the third materials permanently attached to the third base of the third bottom section of the third shoe friction control apparatus include: (i) a suede heel pad; (ii) a cotton ball pad; and (iii) one or more friction increase inserts attached to the ball pad.

5. The shoe friction control apparatus set of claim 1, wherein the third materials permanently attached to the third base of the third bottom section of the third shoe friction control apparatus include: (i) a suede heel pad; (ii) a cotton ball pad; and (iii) one or more suede friction increase inserts attached to the ball pad.

6. The shoe friction control apparatus set of claim 1, wherein the fourth materials permanently attached to the fourth base of the fourth bottom section of the fourth shoe friction control apparatus include: (i) a suede heel pad; (ii) a leather ball pad; and (iii) a cotton toe pad.

7. The shoe friction control apparatus set of claim 1, wherein the fifth materials permanently attached to the fifth base of the fifth bottom section of the fifth shoe friction control apparatus include: (i) a rubbery heel pad; and (ii) a rubbery ball pad.

8. The shoe friction control apparatus set of claim 1, wherein the first materials of the first base of the first bottom section of the first shoe friction control apparatus include: (i) a nylon heel pad; and (ii) a nylon ball pad;

the second materials of the second base of the second bottom section of the second shoe friction control apparatus include: (i) a leather heel pad; and (ii) a cotton ball pad;

the third materials of the third base of the third bottom section of the third shoe friction control apparatus include: (i) a suede heel pad; (ii) a cotton ball pad; and (iii) one or more suede friction increase inserts attached to the ball pad;

the fourth materials of the fourth base of the fourth bottom section of the fourth shoe friction control apparatus include: (i) a suede heel pad; (ii) a leather ball pad; and (iii) a cotton toe pad; and the fifth materials of the fifth base of the fifth bottom section of the fifth shoe friction control apparatus include: (i) a rubbery heel pad; and (ii) a rubbery ball pad.

9. A shoe friction control apparatus set comprising:

at least two of:

(a) a first shoe friction control apparatus including a first body having a first top section, a first right side section, a first left side section, a first front section, a first back section, and a first bottom section, the first body configured to fit on a shoe, said first bottom section including a first base and first materials permanently attached to the first base such that the first bottom section is configured to provide a first amount of slide capability, and wherein the first top section is more stretchable than the first base of the first bottom section;

(b) a second shoe friction control apparatus including a second body having a second top section, a second right side section, a second left side section, a second front section, a second back section, and a second bottom section, the second body configured to fit on a shoe, said second bottom section including a second base and second materials permanently attached to the second base such that the second bottom section is configured to provide a second amount of slide capability, and wherein the second top section is more stretchable than the second base of the second bottom section;

(c) a third shoe friction control apparatus including a third body having a third top section, a third right side section, a third left side section, a third front section, a third back section, and a third bottom section, the third body configured to fit on a shoe, said third bottom section including a third base and third materials permanently attached to the third base such that the third bottom section is configured to provide a third amount of slide capability, and wherein the third top section is more stretchable than the third base of the third bottom section;

(d) a fourth shoe friction control apparatus including a fourth body having a fourth top section, a fourth right side section, a fourth left side section, a fourth front section, a fourth back section, and a fourth bottom section, the fourth body configured to fit on a shoe, said fourth bottom section including a fourth base and fourth materials permanently attached to the fourth base such that the fourth bottom section is configured to provide a fourth amount of slide capability, and wherein the fourth top section is more stretchable than the fourth base of the fourth bottom section; and (e) a fifth shoe friction control apparatus including a fifth body having a fifth top section, a fifth right side section, a fifth left side section, a fifth front section, a fifth back section, and a fifth bottom section, the fifth body configured to fit on a shoe, said fifth bottom section including a fifth base and fifth materials permanently attached to the fifth base such that the fifth bottom section is configured to provide a fifth amount of slide capability, and wherein the fifth top section is more stretchable than the fifth base of the fifth bottom section, wherein:

(i) the first amount of slide capability is greater than the second amount of slide capability, (ii) the second amount of slide capability is greater than the third amount of slide capability, (iii) the third amount of slide capability is greater than the fourth amount of slide capability, and (iv) the fourth amount of slide capability is greater than the fifth amount of slide capability.

10. The shoe friction control apparatus set of claim 9, wherein the first materials permanently attached to the first base of the first bottom section of the first shoe friction control apparatus include: (i) a nylon heel pad; and (ii) a nylon ball pad.

11. The shoe friction control apparatus set of claim 9, wherein the second materials permanently attached to the second base of the second bottom section of the second shoe friction control apparatus include: (i) a leather heel pad; and (ii) a cotton ball pad.

12. The shoe friction control apparatus set of claim 9, wherein the third materials permanently attached to the third base of the third bottom section of the third shoe friction control apparatus include: (i) a suede heel pad; (ii) a cotton ball pad; and (iii) one or more friction increase inserts attached to the ball pad.

13. The shoe friction control apparatus set of claim 9, wherein the third materials permanently attached to the third base of the third bottom section of the third shoe friction control apparatus include: (i) a suede heel pad; (ii) a cotton ball pad; and (iii) one or more suede friction increase inserts attached to the ball pad.

14. The shoe friction control apparatus set of claim 12, wherein the fourth materials permanently attached to the fourth base of the fourth bottom section of the fourth shoe friction control apparatus include: (i) a suede heel pad; (ii) a leather ball pad; and (iii) a cotton toe pad.

15. The shoe friction control apparatus set of claim 9, wherein the fifth materials permanently attached to the fifth base of the fifth bottom section of the fifth shoe friction control apparatus include: (i) a rubbery heel pad; and (ii) a rubbery ball pad.

16. The shoe friction control apparatus set of claim 9, wherein the first materials permanently attached to the first base of the first bottom section of the first shoe friction control apparatus include: (i) a nylon heel pad; and (ii) a nylon ball pad;

the second materials permanently attached to the second base of the second bottom section of the second shoe friction control apparatus include: (i) a leather heel pad; and (ii) a cotton ball pad;

the third materials permanently attached to the third base of the third bottom section of the third shoe friction control apparatus include: (i) a suede heel pad; (ii) a cotton ball pad; and (iii) one or more suede friction increase inserts attached to ball pad;

the fourth materials permanently attached to the fourth base of the fourth bottom section of the fourth shoe friction control apparatus include: (i) a suede heel pad; (ii) a leather ball pad; and (iii) a cotton toe pad; and the fifth materials permanently attached to the fifth base of the fifth bottom section of the fifth shoe friction control apparatus include: (i) a rubbery heel pad; and (ii) a rubbery ball pad.

17. The shoe friction control apparatus set of claim 1, wherein:

(a) the first base of the first bottom section of the first shoe friction control apparatus is less stretchable than the first right side section, the first left side section, the first front section, and the first back section of the first shoe friction control apparatus;

(b) the second base of the second bottom section of the second shoe friction control apparatus is less stretchable than the second right side section, the second left side section, the second front section, and the second back section of the second shoe friction control apparatus;

(c) the third base of the third bottom section of the third shoe friction control apparatus is less stretchable than the third right side section, the third left side section, the third front section, and the third back section of the third shoe friction control apparatus;

(d) the fourth base of the fourth bottom section of the fourth shoe friction control apparatus is less stretchable than the fourth right side section, the fourth left side section, the fourth front section, and the fourth back section of the fourth shoe friction control apparatus; and (e) the fifth base of the fifth bottom section of the fifth shoe friction control apparatus is less stretchable than the fifth right side section, the fifth left side section, the fifth front section, and the fifth back section of the fifth shoe friction control apparatus.

18. The shoe friction control apparatus set of claim 8, wherein:

(a) the first base of the first bottom section of the first shoe friction control apparatus is less stretchable than the first right side section, the first left side section, the first front section, and the first back section of the first shoe friction control apparatus;

(b) the second base of the second bottom section of the second shoe friction control apparatus is less stretchable than the second right side section, the second left side section, the second front section, and the second back section of the second shoe friction control apparatus;

(c) the third base of the third bottom section of the third shoe friction control apparatus is less stretchable than the third right side section, the third left side section, the third front section, and the third back section of the third shoe friction control apparatus;

(d) the fourth base of the fourth bottom section of the fourth shoe friction control apparatus is less stretchable than the fourth right side section, the fourth left side section, the fourth front section, and the fourth back section of the fourth shoe friction control apparatus; and (e) the fifth base of the fifth bottom section of the fifth shoe friction control apparatus is less stretchable than the fifth right side section, the fifth left side section, the fifth front section, and the fifth back section of the fifth shoe friction control apparatus.

* * * * *